US006019618A

United States Patent [19]

Nakata

[11] Patent Number: 6,019,618

[45] Date of Patent: Feb. 1, 2000

[54] LEVER-TYPE CONNECTOR WITH BENDING PREVENTING MEMBER

[75] Inventor: Hiroyuki Nakata, Yokkaichi, Japan

[73] Assignee: Sumitomo Wiring Systems, Ltd., Japan

[21] Appl. No.: 08/907,899

[22] Filed: Aug. 11, 1997

[30] Foreign Application Priority Data

Feb. 5, 1997 [JP] Japan ..... 9-022867

[51] Int. Cl.[7] ..... H01R 13/62

[52] U.S. Cl. ..... 439/157; 439/160

[58] Field of Search ..... 439/157, 160, 439/372, 152, 155, 159

[56] References Cited

U.S. PATENT DOCUMENTS 5,562,465 10/1996 Taguchi et al. ..... 439/157
5,603,624 2/1997 Taguchi et al. ..... 439/157
5,676,556 10/1997 Yamaguchi et al. ..... 439/157

FOREIGN PATENT DOCUMENTS 0 599 332 6/1994 European Pat. Off. .
0 717 466 6/1996 European Pat. Off. .
1954300 5/1996 Germany .

*Primary Examiner*—Paula Bradley
*Assistant Examiner*—Tho Dac Ta
*Attorney, Agent, or Firm*—Banner & Witcoff, Ltd.

[57] ABSTRACT

An upper face of a female connector housing 10 has arc-shaped ribs 15 to support contact members 25 of a pivotable lever 20. If the operating force applied to the lever 20 is large the tendency for the lever 20 to bend towards the connector housing 10 is resisted. Engagement of cam tracks 24 with protrusions of a corresponding connector housing is thereby assured.

14 Claims, 7 Drawing Sheets

LEVER-TYPE CONNECTOR WITH BENDING PREVENTING MEMBER

TECHNICAL FIELD

The present invention relates to a lever-type connector-of the kind that cause connector housings to be drawn together and separated by means of the movement of a lever.

BACKGROUND TO THE INVENTION

As shown in FIG. 8 of this specification, a levertype connector comprises a connector housing 1 and a lever 2. The lever 2 has a pair of plate shaped arms 2B located at the ends of a long operating member 2A. The lever 2 is pivotably supported about an axis by means (not shown) provided in the arms 2B. When a corresponding connector housing 3 is fixed to the connector housing 1, cam protrusions 3A on the corresponding connector housing 3 (shown in detail in FIG. 9) are made to fit with cam grooves 2C on the arms 2B, rotation of the lever 2 causing the connector housings 1 and 3 to be drawn together. When separation is to be carried out, the lever 2 is pivoted in the opposite direction.

In the lever-type connector, when the lever 2 is pivoted, an operating force is applied against the operating member 2A towards the connector housing 1. If the fitting resistance or separation resistance between the connector housings is large, the operating force applied to the operating member 2A is also inevitably increased.

In these circumstances the operating member 2A bends towards the connector housing 1 and in accompaniment with this the arms 2B spread. As shown in an enlarged view in FIG. 10, the linking of the cam protrusion 3A and the cam groove 2C becomes slight and less effective.

The present invention has been developed after taking the above problem into consideration, and aims to present a lever-type connector wherein excessive bending of the operating member can be prevented.

SUMMARY OF THE INVENTION

According to the invention there is provided a lever-type connector comprising a housing having a 'U' shaped lever pivoted thereto for movement through an arc, the lever having opposite arms, one end of each arm being pivoted to a respective side of the housing about a common pivot axis, and the other end of each arm being connected to an operating member which spans the housing characterized in that one of said operating member and housing are provided with a bending preventing member adapted to prevent bending of said operating member towards said housing.

Such a bending preventing member, for example one or more upstanding ribs of the housing, can support the operating member against bending, and thus ensure complete engagement between the cam grooves of the lever and the cam protrusions of the mating connector.

The bending preventing member(s) may be spaced at a slight clearance or may be in light rubbing contact with the operating member or housing, as the case may be.

Preferably the bending preventing member has a contact surface on a radius of the pivot axis, and may be effective throughout the pivot range of the lever. Alternatively the bending preventing member may act only at the point where bending is likely; this arrangement simplifies moulding and facilitates miniaturization of the connector.

In a preferred embodiment the connector has a movement preventing member for preventing sideways movement of the operating member in the direction of the pivot axis; the movement preventing member may abut the bending preventing member so constraining the lever for movement only along the specified arc.

BRIEF DESCRIPTION OF DRAWINGS

Other features of the invention will be apparent from the following description of preferred embodiments shown by way of example only in the accompanying drawings in which.

DESCRIPTION OF PREFERRED EMBODIMENTS

Figure 1:
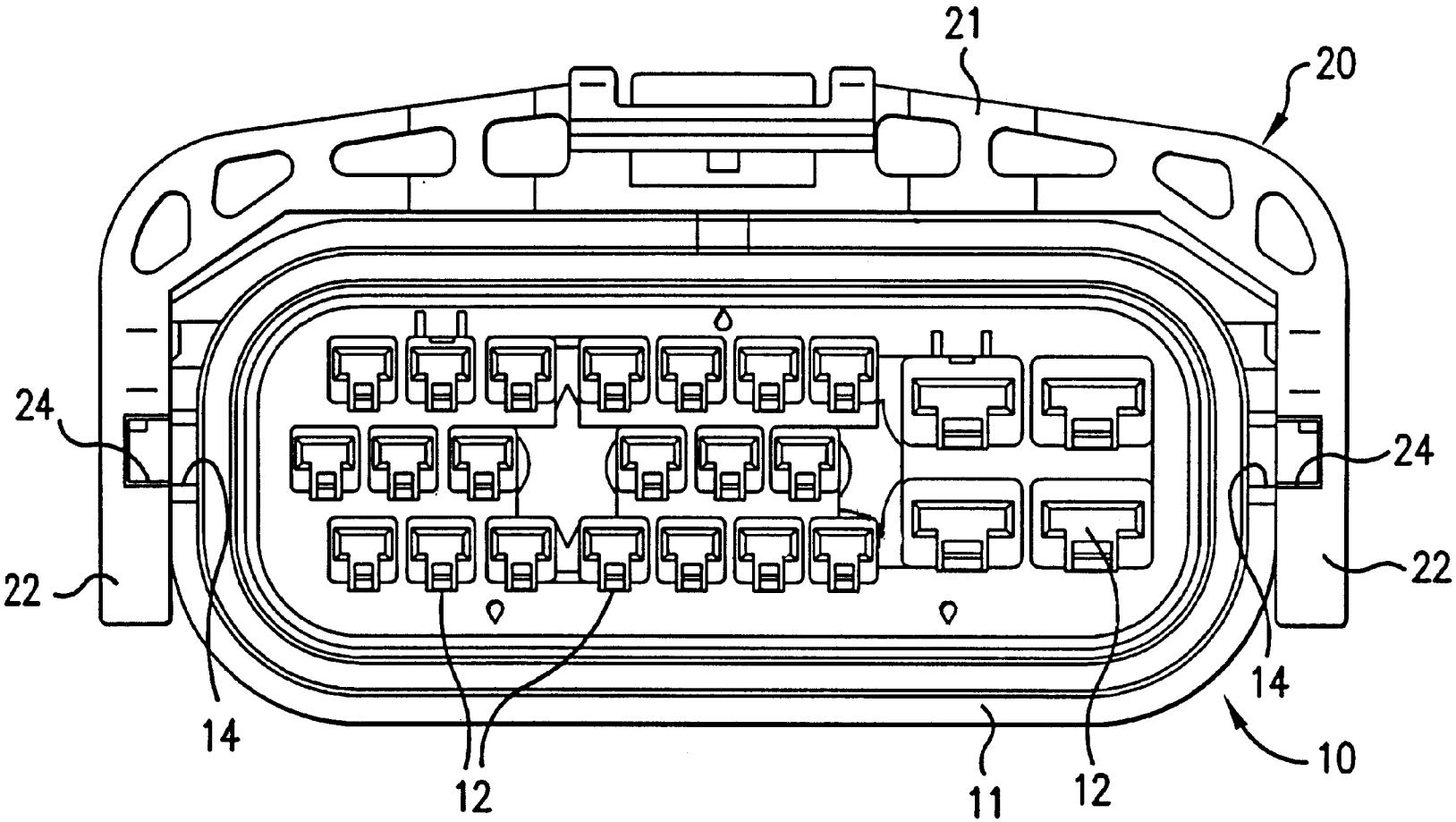
FIG. 1 is a front view showing an embodiment of the invention with a lever in an initial fitting position.

An embodiment of the present invention is explained below, with the help of FIGS. 1 to 5.

A female connector housing 10 has a guiding tubular member (hood) 11 for receiving a male connector housing, a plurality of cavities 12 opening out on the interior face and having female terminal fittings (not shown) housed therein. The left and right side faces of the housing 10 have a pair of coaxial stub axles protruding therefrom. The tubular member 11 has cut-away grooves 14 for preventing interference with cam protrusions (not shown) of the male connector housing.

The lever 20 has a long operating member 21 that extends in a direction parallel to the pivot axis 13 of the stub axles. Axle receiving holes 23 formed on the arms 22 fit with the stub axles to allow the lever 20 to pivot about axis 13.

Figure 3:
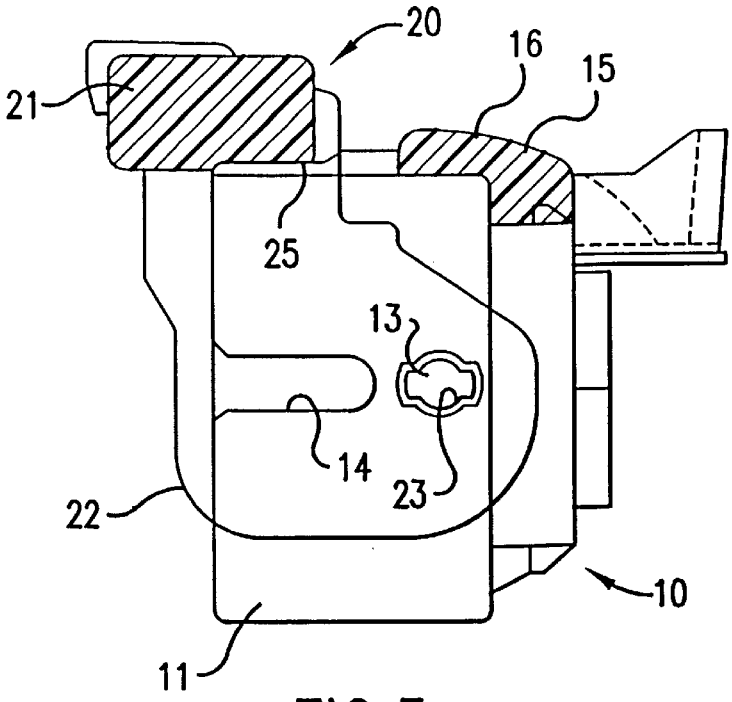
FIG. 3 is a schematic side view corresponding to FIG. 1.

When the male connector housing and the female connector housing 10 are to be fitted together, the lever 20 is in an initial position shown in FIG. 3. The anterior end of the male connector housing fits into the anterior end of the tubular member 11 and cam protrusions (not shown) are inserted into the openings of cam grooves 24 formed on the inner faces of the arms 22. From this state, the lever 20 is pivoted in a clockwise direction, to the state shown in FIG. 5. Due to the cam effect, the male connector housing is pulled into the tubular member 11. This is conventional.

When the male connector housing and the female connector housing 10 are to be separated, the lever 20 is pivoted in the opposite direction, and due to the fitting of the cam protrusion and the cam groove 24, the male connector housing is pushed out from the tubular member 11 and thus separated.

When the lever 20 is to be pivoted as described above, the operator places a finger on the operating member 21 and pushes the operating member 21 in the direction of movement. In the case where the fitting resistance or separation resistance caused by friction between male and female terminal fittings (not shown) is large, the operating member 21 needs to be pushed rather hard. In order to apply a stronger operating force, it is preferable to apply both the thumbs to the operating member and to rest the remaining fingers under the female connector housing 10.

Figure 4:
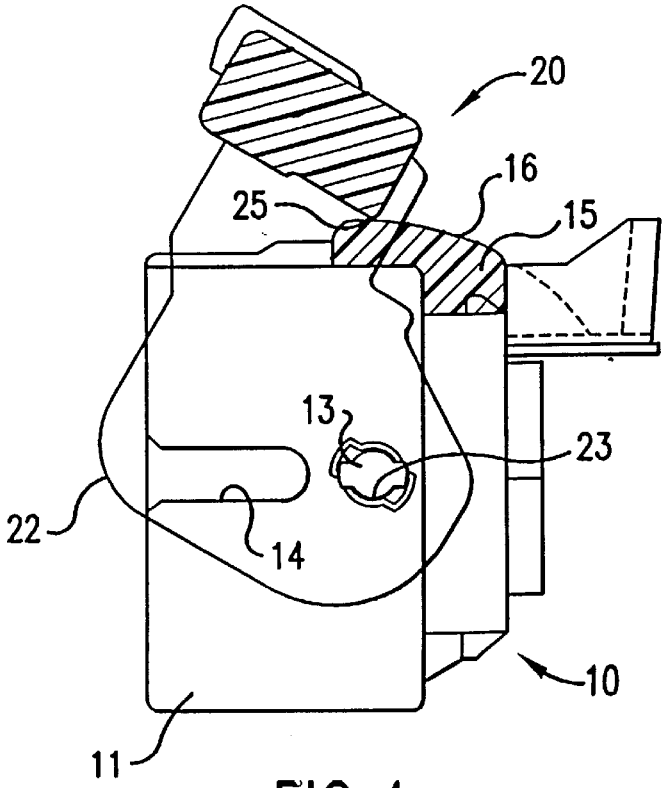
FIG. 4 is a schematic side view corresponding to FIG. 2.
Figure 5:
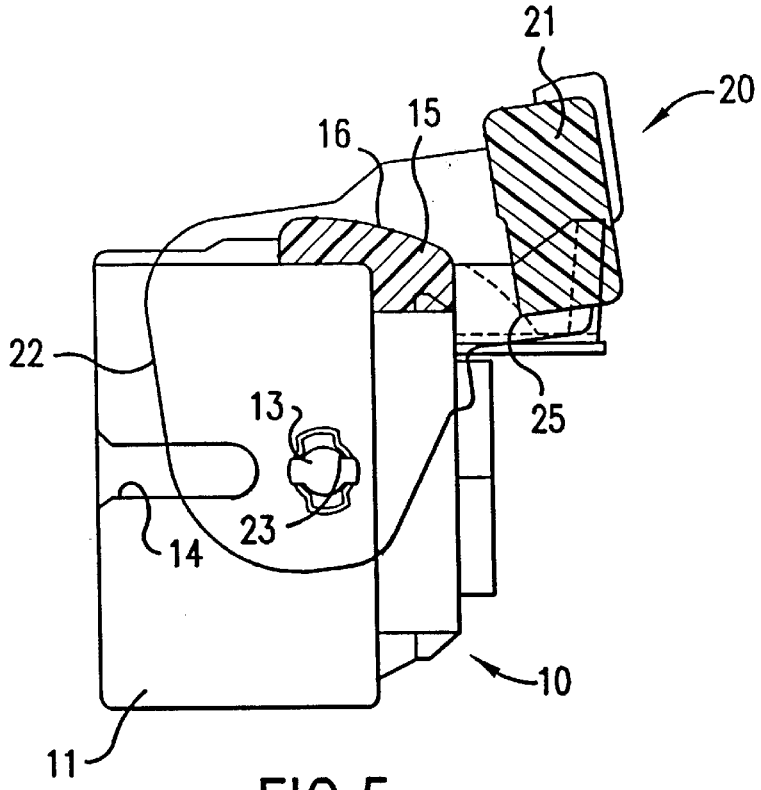
FIG. 5 is a schematic side view showing the lever of FIG. 1 pivoted to a final fitting position.
Figure 9:
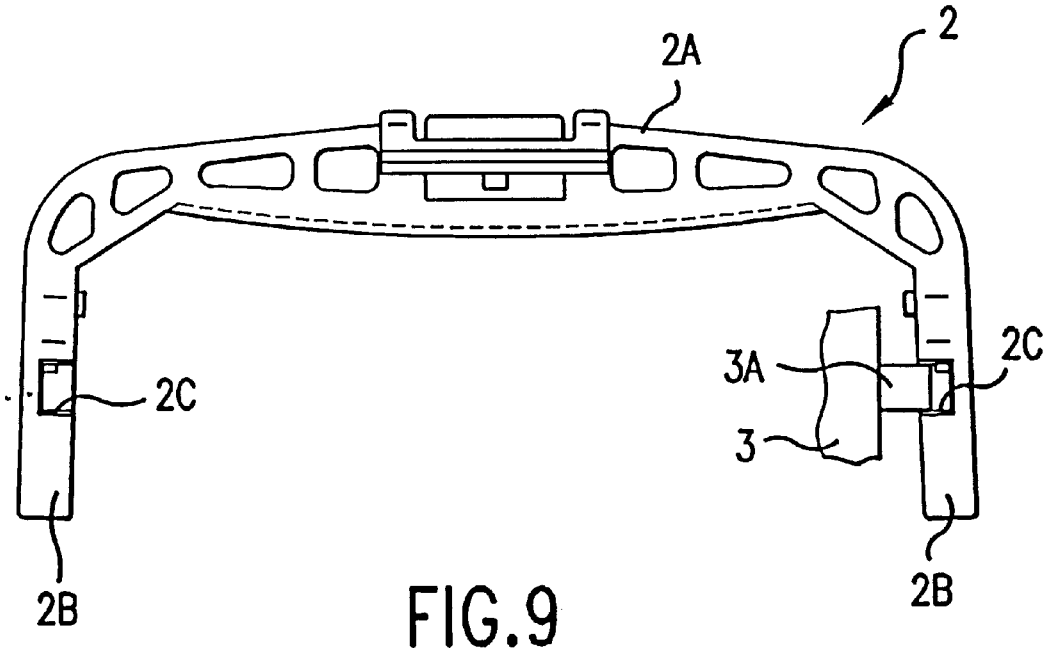
FIG.9 PRIOR ART
FIG. 9 is a front view of a prior art lever showing bending of an operating member.
Figure 10:
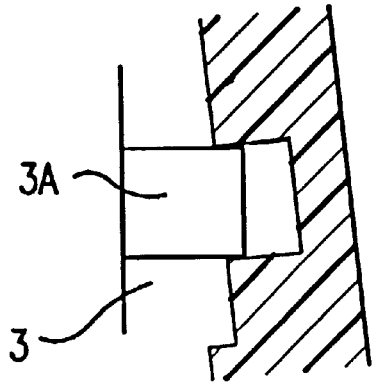
FIG.10 PRIOR ART
FIG. 10 is a partially enlarged cross-sectional view corresponding to FIG. 9 and showing the relationship between a cam protrusion and a cam groove.

However, when the operating member 21 is pushed by means of the thumbs, it tends to not only experience a force in the pivoting direction but also to experience a force from the exterior periphery towards the axis 13. In particular, this tendency increases when the operating member 21 is pushed from the anterior or posterior direction towards a location directly above the axis 13, as shown in FIG. 4. When the force on the operating member 21 exceeds a specified amount, the operating member 21 changes shape so as to cause the central portion to curve downwards (towards the upper face of the female connector housing 10), and the arms 22 move so as to open out diagonally. As a result, there is a possibility in a decrease in the engagement between the cam protrusion and the cam groove and a consequent fall in the cam function, as shown in the conventional example (FIG. 9 and FIG. 10).

However, in the present embodiment, a means has been provided for preventing the curving change in shape of the operating member 21.

Figure 2:
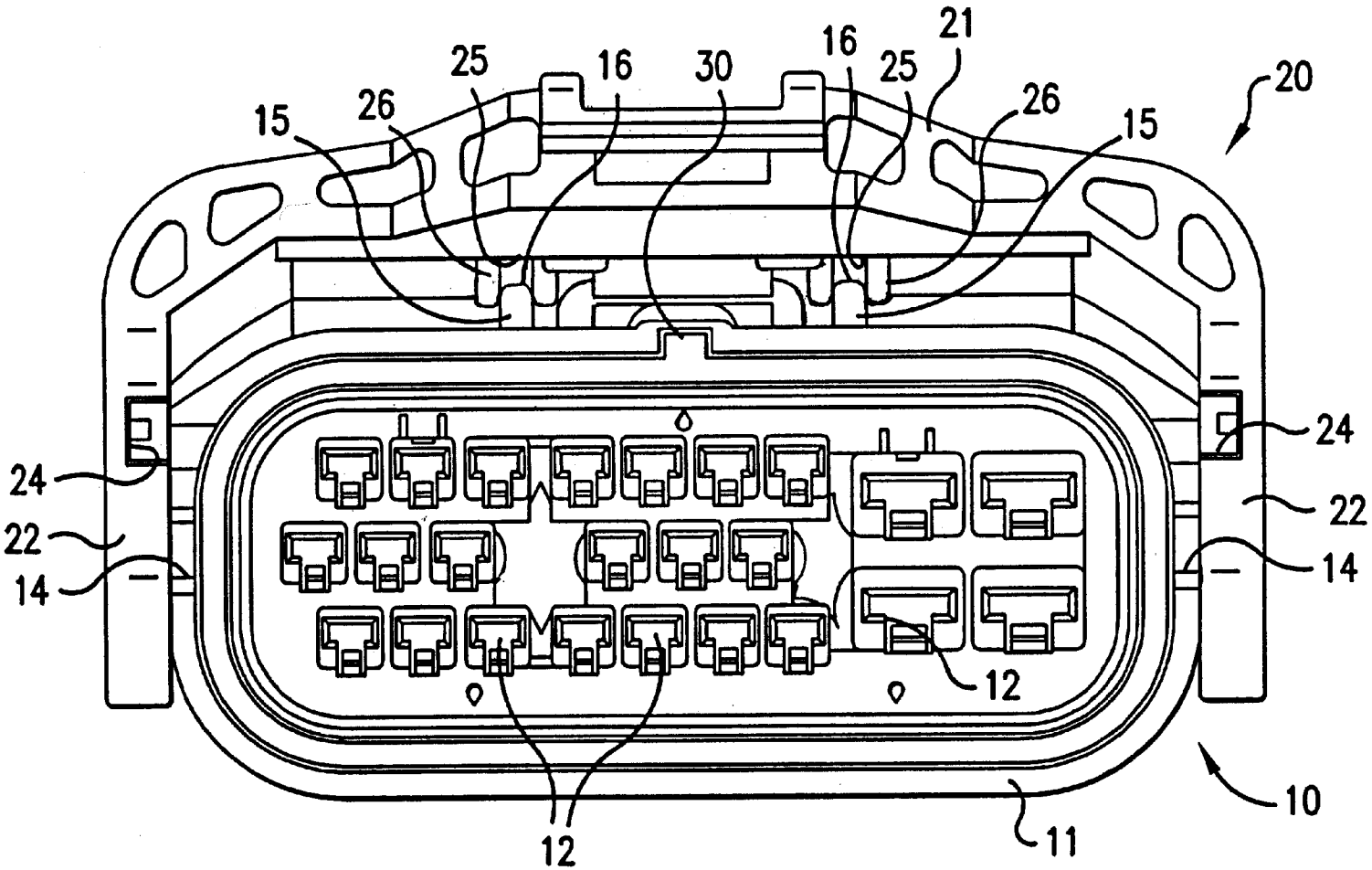
FIG. 2 is a front view corresponding to FIG. 1 with the lever pivoted to an intermediate fitting position.

The means for preventing change in shape of the operating member 21 comprises ribs 15, and contact members 25 located on the lower side of the operating member 21, shown in FIG. 2.

As shown in FIG. 2, the ribs 15 are formed to the left and right on the upper face of the female connector housing 10, in a location that is close to the centre of the operating member 21 and on either side of the usual latch 30. In this way, the location of the ribs 15 takes into account the largest possible deflection of the centre of the operating member 21.

When seen from the side the ribs 15 are located in the posterior region on the upper face of the female connector housing 10, and the location is chosen so that the contact members 25 of the operating member 21 correspond to the ribs 15 when the operating force applied to the operating member 21 exceeds the bending strength thereof.

The upper faces of the ribs 15 (the exterior peripheral faces) form arc-shaped contact faces 16 having centres corresponding to the axis 13. The radius of the contact faces 16 is set to a dimension whereby, in the case where the operating member 21 is not bent, its contact member 25 is separated or makes contact smoothly without a large frictional force occurring.

Additionally, the operating member 21 has a pair of left and right movement prevention members 26 protruding from the exterior ends with respect to the left and right ribs 15 and capable of making contact therewith (see FIG. 2).

The lever 20 has a conventional resilient latch 30 at the middle thereof to retain the lever against movement with respect to the housing at the fitted end of its travel.

Operation of the present embodiment is as follows. When the male connector housing is to be fixed to the female connector housing 10, as shown in FIG. 4, the fitting resistance increases significantly between the movement of the operating member 21 from a location approximately directly above the axis 13 and towards its posterior side (the right side in FIG. 4), and the force required for pushing the operating member 21 towards the female connector housing 10 consequently increases. However, as shown in FIG. 4, since the operating member 21 is supported by the contact faces 16, there is no possibility of the operating member 21 moving towards the axis 13. In other words, the operating member 21 is prevented from bending.

In the case where the connector housings are to be separated, the separation resistance increases to the same extent as during fitting, and the force on the operating member 21 acting down towards the female connector housing 10 also increases. As in the case where fitting is being carried out, the contact members 25 make contact with the contact faces 16 and thereby prevent the operating member 21 from bending.

Since the bending of the operating member 21 is prevented-during fitting or separation, it becomes possible to prevent a decrease in the engagement between the cam protrusions and the cam grooves 24 due to spreading of the arms 22. Consequently, a superior cam function is achieved, and fitting and separation operations are carried out smoothly and with certainty.

Further, in the state where the operating member 21 is not bent, the contact members 25 and the ribs 15 are in light contact, and the operating member 21 does not bend at all, resulting in a highly effective prevention of bending.

The invention has the advantage that the female connector housing 10 can be miniaturized, and the mould configuration simplified since the range over which the ribs 15 are provided is limited to the range required for movement of the operating member 21.

Furthermore, the contact faces 16 have the same centre as the axis 13; accordingly, there is no possibility of any interference occurring between the contact members 25 and the ribs 15 when the operating member 21 is pivoted.

Since the ribs 15 are provided on the female connector housing 10, unlike the case where rib-shaped bending prevention members are provided on the operating member 21, there is no possibility of bending prevention members causing interference when a finger is placed on the operating member 21. Accordingly, a fall in operability due to the presence of the ribs 15 is prevented.

Moreover, the ribs 15 are located in the central region of the operating member 21. Accordingly, compared to the case where the ribs 15 are located closest to the ends (where the bending of the operating members 21 is slight), the bending preventing function of the operating member 21 is effectively carried out.

In the present embodiment, the operating member 21 has a movement prevention member 26 that fits with the ribs 15. In the case where, for example, the operating force on the operating member 21 is not at a right angle with respect to the axis 13 but is applied diagonally, it becomes possible to prevent the lever 20 from moving sideways. Consequently, instability of the fitted state of the cam protrusions and the cam grooves 24 due to movement of the lever 20 in the axial direction,of the pivot axis 13 can be prevented.

Since this movement preventing means uses the ribs 15 which are also the bending preventing means, separate movement prevention means are not necessary, and this facilitates miniaturization of the connector.

Figure 6:
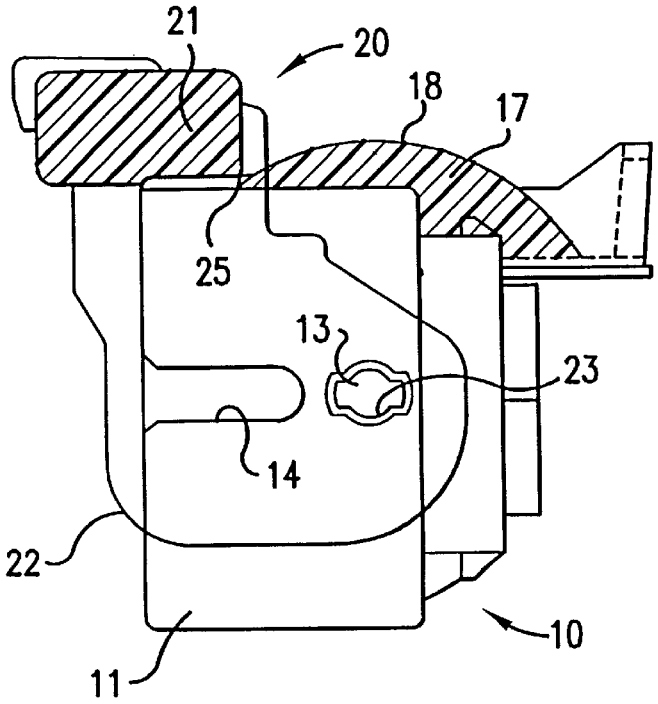
FIG. 6 is a schematic side view showing a second embodiment of the invention with a lever in an initial fitting position.
Figure 7:
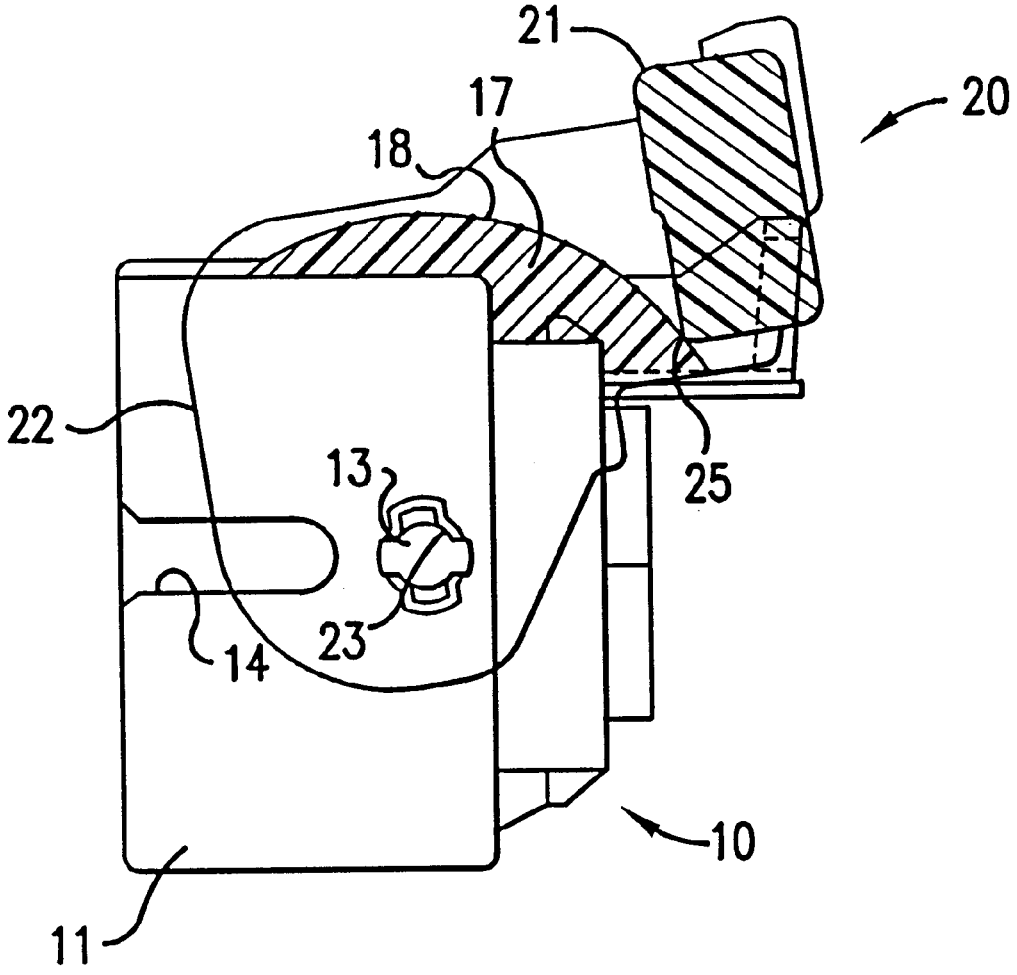
FIG. 7 is a schematic side view corresponding to FIG. 6 and with the lever pivoted to a final fitting position.
Figure 8:
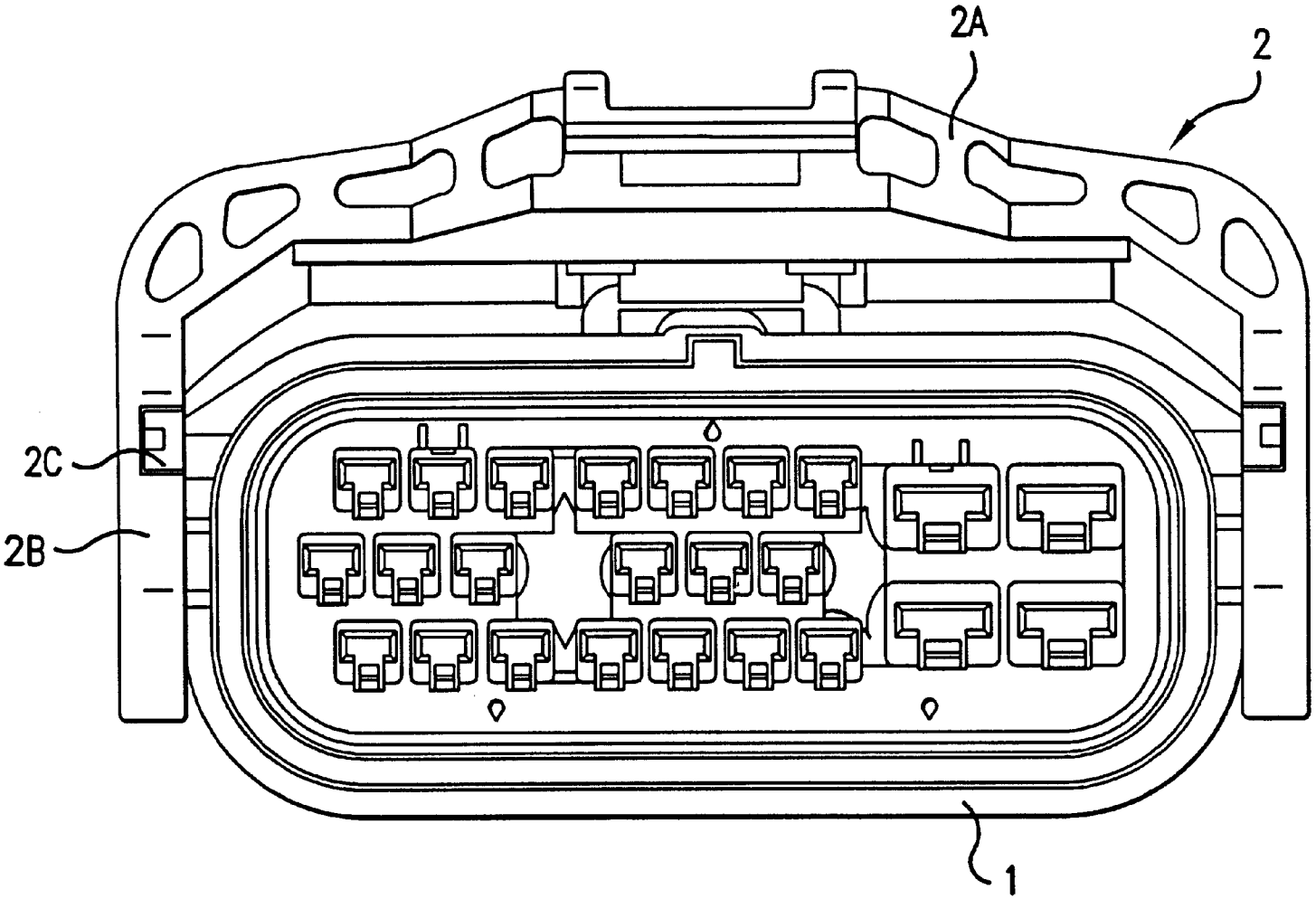
FIG. 8 is a front view of a prior art example in an intermedire fitting position.

A second embodiment of the present invention is now described with the aid of FIGS. 6 and 7.

In this embodiment, the ribs have a configuration different from that of embodiment 1. Since the configuration of the other parts is the same as in embodiment 1, the same numbers are accorded to parts having the same configuration as in embodiment 1, and an explanation thereof omitted.

Ribs 17 of embodiment 2 are formed so as to correspond to the entire range of movement of an operating member 21. In other words, irrespective of whether the operating member 21 is at the initial fitting position shown in FIG. 6 or in the final fitting position shown in FIG. 7, contact members 25 are maintained in a state whereby they are in constant light contact with arc-shaped contact faces 18.

In embodiment 2 as well, if a strong force is applied against the operating member 21 downwards and towards the female connector housing 10, the contact members 25 make contact with the ribs 17 and the bending of the operating member 21 is prevented from occurring with certainty.

Moreover, the bending preventing means of the operating member 21 extends along the entire range of movement of the operating member 21. Accordingly, in the case where an excessive force applies on the operating member 21 at the initial fitting position or the final fitting position, or a force other than an operating force is applied to the operating member 21, the bending thereof can be prevented.

The present invention is not limited to the embodiments described above with the aid of figures. For example, the possibilities described below also lie within the technical range of the present invention. In addition, the present invention may be embodied in various other ways without deviating from the scope thereof.

(1) In the above embodiments, the operating member is arranged to make contact with the ribs (bending preventing members). However, according to the present embodiment, it may equally be arranged so that the ribs do not make contact with the operating member along the entire range of movement. In such a case as well, if the space between the operating member and the ribs is made smaller, it becomes possible to prevent excessive bending of the operating member. Further, in the case where no contact occurs along the entire range of movement, there is no operation resistance caused by contact of the operating member and the ribs; consequently, greater operability can be expected.

(2) In the above embodiments, it is arranged so that the operating member makes contact over the entire range of the ribs. However, according to the present embodiment, it may equally be arranged so that it makes contact with only a portion of the range of the ribs, and the rest of the range does not make contact at all.

(3) In the above embodiments, it is arranged so that the external periphery of the ribs have arc-shaped faces that have the same centre as the axis of the operating member. However, according to the present embodiment, it may equally be arranged so that the external periphery of the ribs have a shape different from this arc provided that support is given to the operating member.

(4) In the above embodiments, it is arranged so that the bending prevention members are constituted from ribs protruding from the external face of the female connector housing. However, it may equally be arranged so that a bending preventing means is formed by ribs protruding from the operating member. In such a case, the ribs have a form whereby they protrude from the operating member in a large arc-shape from the anterior or posterior ends of the direction of movement. The ribs are made to either be at a proximate distance with respect to one point of the external face of the female connector housing, or are made to make contact therewith.

(5) In the above embodiments, it is arranged so that the bending prevention members are ribs protruding from the female connector housing. However, according to the present embodiment, it may equally be arranged so that an arc-shaped groove is formed in the female connector housing, the operating member having protrusions corresponding to the arc-shaped face thereof.

(6) In the above embodiments, it is arranged so that the ribs (the bending prevention members) are located at approximately the centre of the lengthwise dimension of the operating member, that is, at that point on the operating member where the amount of bending is greatest. However, it may equally be arranged so that these are located at a position slightly displaced with respect to the point where the bending is the greatest depending on the strength of the operating member, and the allowable degree of bending thereof.

(7) In the above embodiment, the bending prevention members have the additional function of preventing movement along the lever axis. However, it may equally be arranged so that the movement preventing means of the lever is separate from the bending prevention members.

(8) In the above embodiment, it is arranged so that a movement preventing means is provided for controlling movement along the lever axis. This movement prevention means need not necessarily be provided.

What is claimed is:

1. A lever-type connector comprising a housing having a 'U' shaped lever pivoted thereto for movement through an arc between an open position and a closed position, the lever having opposite arms, one end of each arm being pivoted to a respective side of the housing about a common pivot axis, and the other end of each arm being connected to an operating member which spans the housing, wherein one of said operating member and said housing is provided with a bending preventing member adapted to prevent bending of said operating member towards said housing at least along a mid portion of the arc between said open and closed positions.

2. A connector according to claim 1 wherein the bending preventing member has a contact face for contact with the other of said housing and operating member, said contact face being at a constant radius from said pivot axis.

3. A connector according to claim 1 wherein the bending preventing member is in a mid region of said operating member.

4. A connector according to claim 1 wherein the other of said operating member and housing is provided with a movement preventing member adapted for abutment with said bending preventing member and for preventing movement of said operating member in the direction of said pyot axis.

5. A connector according to claim 4 wherein the bending preventing member is an upstanding rib of said housing, and the movement preventing member comprises two depending ribs of said operating member, one depending rib being on either side of said upstanding rib.

6. A connector according to claim 1 and further including a latch at the middle of said operating member for retaining the lever against movement relative to the housing, a bending preventing member being provided on either side of said latch.

7. A connector according to claim 1 wherein the bending preventing member is spaced from said operating member by a small clearance when said operating member is at rest.

8. A connector according to claim 7 wherein the bending preventing member is effective throughout movement of the operating member through said arc.

9. A connector according to claim 1 wherein the bending preventing member makes light contact with said operating member.

10. A connector according to claim 9 wherein the bending preventing member is effective throughout movement of the operating member through said arc.

11. A connector according to claim 1 wherein the bending preventing member is effective throughout movement of the operating member through said arc.

12. A connector according to claim 11 wherein the other of said operating member and housing is provided with a movement preventing member adapted for abutment with said bending preventing member and for preventing movement of said operating member in the direction of said pivot axis.

13. A connector according to claim 1 wherein the bending preventing member comprises one or more upstanding ribs of said housing.

14. A connector according to claim 13 wherein the other of said operating member and housing is provided with a movement preventing member adapted for abutment with said bending preventing member and for preventing movement of said operating member in the direction of said pivot axis.

* * * * *